US007334571B1

(12) United States Patent
Beardmore

(10) Patent No.: US 7,334,571 B1
(45) Date of Patent: Feb. 26, 2008

(54) ISOLATION SYSTEM FOR HIGH PRESSURE SPARK IGNITION DIRECT INJECTION FUEL DELIVERY COMPONENTS

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 30 days.

(21) Appl. No.: 11/468,836

(22) Filed: Aug. 31, 2006

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/456, 467, 468, 469
See application file for complete search history.

(56) References Cited

U.S. PATENT DOCUMENTS 6,148,797 A * 11/2000 Gmelin ..... 123/456
6,418,911 B1 * 7/2002 Augustin ..... 123/468
6,543,421 B2 * 4/2003 Lorraine et al. ..... 123/470
6,830,034 B2 * 12/2004 Engelmeyer et al. ..... 123/470
2001/0037796 A1 * 11/2001 Lorraine et al. ..... 123/470
2001/0050073 A1 * 12/2001 Engelmeyer et al. ..... 123/456
2003/0230282 A1 * 12/2003 Braun et al. ..... 123/456
2004/0112338 A1 * 6/2004 Berger et al. ..... 123/468
2004/0194760 A1 * 10/2004 Streb et al. ..... 123/456
2005/0045154 A1 * 3/2005 Marksteiner et al. ..... 123/468
2007/0000480 A1 * 1/2007 Hoenig et al. ..... 123/470

* cited by examiner

*Primary Examiner*—Mahmoud Gimie

(57) ABSTRACT

A fuel injector isolation system in a high pressure fuel injection system comprises an isolated fuel rail assembly. At least one cylinder has a cylinder head. A fuel injector is coupled to and in fluid communication with the fuel rail assembly, extends axially through an opening in the cylinder head, and is moveable within the opening in relation to the cylinder head.

20 Claims, 8 Drawing Sheets

ISOLATION SYSTEM FOR HIGH PRESSURE SPARK IGNITION DIRECT INJECTION FUEL DELIVERY COMPONENTS

FIELD OF THE INVENTION

The present invention relates to high pressure spark ignition direct injection (SIDI) fuel delivery, and more particularly to an attachment system for high pressure fuel injectors in an isolated SIDI fuel delivery system.

BACKGROUND OF THE INVENTION

Spark ignition direct injection (SIDI) combustion systems (and other direct injection combustion systems) for internal combustion engines provide improved fuel economy and increased power over conventional port fuel-injected combustion systems. A SIDI engine includes a high pressure fuel injection system that sprays fuel directly into a combustion chamber. The fuel is directed to a specific region within the combustion chamber. As a result, a homogeneous or stratified charge may be created in the combustion chamber as desired. Throttling requirements are less restrictive and fuel combustion characteristics are improved, thereby improving fuel economy and engine output.

Referring now to FIG. 1, an exemplary SIDI engine 10 includes an engine block 12 that includes one or more cylinders 14. A spark plug 16 extends into a combustion chamber 18. The combustion chamber 18 is defined by a piston 20, the cylinder 14, and a cylinder head 21. The cylinder 14 includes one or more exhaust ports 22 and corresponding exhaust valves 24. The cylinder 14 includes one or more intake ports 26 and corresponding intake valves 28. A fuel injector 30 extends into the combustion chamber 18. One or more of the fuel injectors 30 are connected to a fuel rail 32.

Referring now to FIGS. 1 and 2, the fuel rail 32 provides fuel to the fuel injectors 30. The fuel injectors 30 deliver fuel to the combustion chamber 18 according to performance requirements of the SIDI engine 10. Typically, a low pressure (e.g. approximately 45-75 psi) fuel supply pump 40 is located within a fuel tank 42. The low pressure fuel supply pump 40 delivers fuel to a high pressure injection pump 44. The injection pump 44 pressurizes the fuel at approximately 750 to 2250 psi, depending on demand. The injection pump 44 provides the pressurized fuel to the fuel rail 32. The fuel rail 32 is rigidly fastened to the cylinder head 21 of the cylinder 14. For example, the fuel rail 32 is fastened to the cylinder head 21 via a fuel rail attachment assembly (not shown). The fuel injector 30 is rigidly fastened (e.g., clamped) between the fuel rail 32 and the cylinder head 21, or another suitable fixture of the SIDI engine 10. A location of the fuel injector 30 relative to the combustion chamber 18, as well as a design of a fuel injector nozzle 46, are optimized to achieve desired combustion characteristics.

SUMMARY

A fuel injector isolation system in a high pressure fuel injection system comprises an isolated fuel rail assembly. At least one cylinder has a cylinder head. A fuel injector is coupled to and in fluid communication with the fuel rail assembly, extends axially through an opening in the cylinder head, and is moveable within the opening in relation to the cylinder head.

In other features, a vehicle comprises an engine block that includes at least one combustion cylinder having a cylinder head and a combustion chamber. A high pressure fuel injection system delivers fuel directly into the combustion chamber. The high pressure fuel injection system includes an isolated fuel rail assembly and a fuel injector coupled to and in fluid communication with the fuel rail assembly that extends axially through an opening in the cylinder head and is moveable within the opening in relation to the cylinder head.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 2:
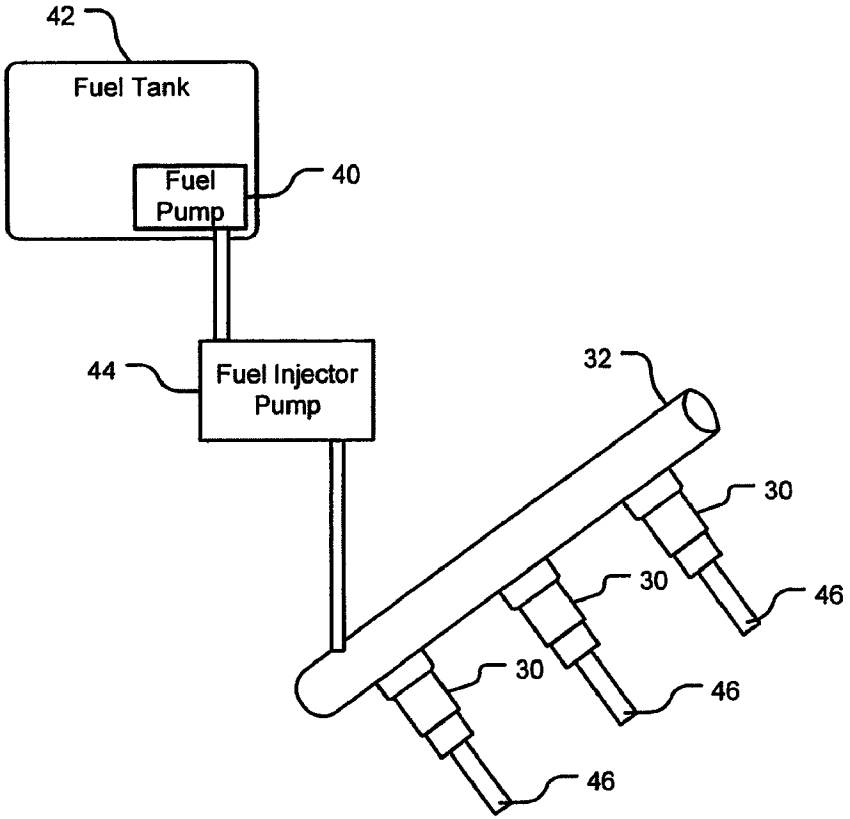
FIG. 2 Prior Art
FIG. 2 is a functional block diagram of a SIDI fuel rail assembly according to the prior art.

The following description of the preferred embodiment(s) is merely exemplary in nature and is in no way intended to limit the invention, its application, or uses. For purposes of clarity, the same reference numbers will be used in the drawings to identify similar elements.

A typical SIDI system generates undesirable noise during normal operation. As used herein, the term noise refers to any unwanted or undesirable noise that is generated during normal operation of electrical, mechanical, and/or electromechanical devices. The noise is not indicative of present and/or potential damage to these devices. As shown in FIGS.

3A and 3B, pressure pulsations (i.e. disturbances) on a right fuel rail and a left fuel rail are indicated at 60 and 62, respectively. Pressure fluctuations are indicated at 64 for the fuel inlet line. The pressure pulses 60, 62, and 64 are synchronous with the electronic solenoid command signal 66 (e.g., from a Powertrain Control Module, or PCM) which controls the high pressure injection pump 44. These system pressure disturbances 60, 62, and 64 excite various components of the SIDI engine to radiate unwanted noise pulses as indicated at 68, 70, 72, and 74, for example. Sharp pressure pulses generated within the high pressure pump 44 at each pump stroke contribute to unwanted audible noise. Conventionally, the high pressure injection pump is controlled electronically. For example, the high pressure injection pump includes a reciprocating plunger in communication with an electronic governed solenoid valve that maintains the desired fuel rail (injection) pressure. The electronic signal pulses 66 control the pump's solenoid valve as dictated by the PCM. Similarly, secondary high frequency rail pressure pulses 60 and 62 are generated at each injector firing as high pressure fuel is discharged (injected) into the combustion chamber 18. Together, the pressure impulses generated by both the pump and injectors constitute the majority of impulsive noise excitation to the engine.

Additionally, operation of the fuel injectors cause the SIDI system to generate noise. An impulse is generated each time the fuel injector "fires" (i.e. delivers fuel to the combustion chamber), which can be seen to be coincident with the electronic PCM signal pulses 76. These impulses are simultaneously comprised of both electromechanical (solenoid) and electro-hydraulic forces. The fuel injectors include electronically-controlled needle valve openings. The opening and closing actuation (e.g. electromechanical and/or hydraulic actuation) of the needle valve openings cause the noise pulses 78.

As described above, operation of the injection pump and the fuel injectors contribute significantly to the impulsive noise that the SIDI system generates. In particular, rigid mechanical contact between the fuel rail and the cylinder head, as well as between the fuel injector and the cylinder head, transfer noise energy between the SIDI system and various components of the engine. The present invention provides a fuel injector attachment system for high pressure SIDI fuel delivery systems that incorporate noise isolation technology. More specifically, the present invention provides a SIDI system that directly couples the fuel injectors to the fuel rail assembly and isolates elements of the fuel injectors from the cylinder head to interrupt transmission paths of noise energy. With the injector fastened to the rail in the manner described herein, the rail isolation limits vibration energy from being transmitted into the engine.

Figure 4:
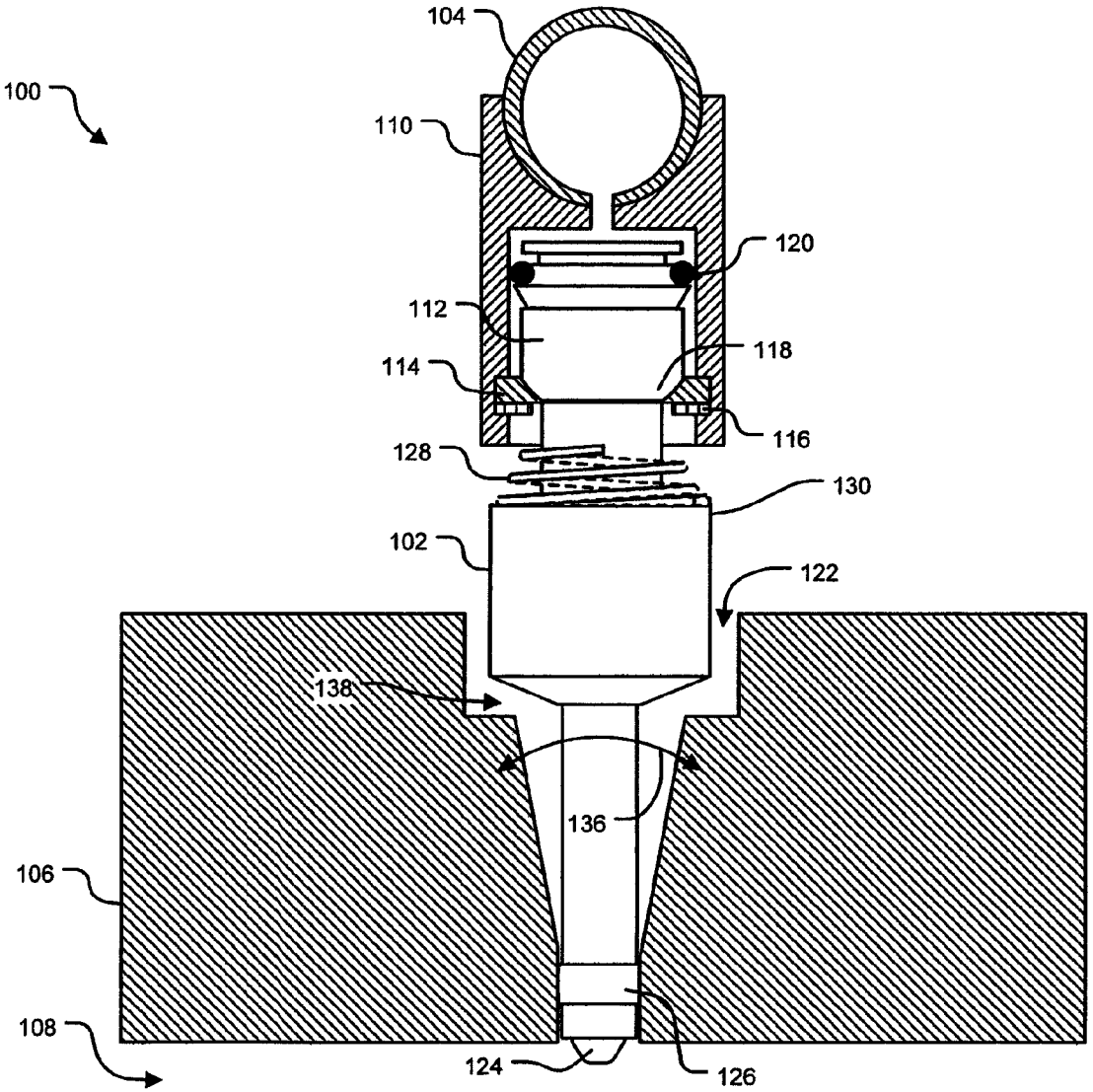
FIG. 4 is a cross-sectional view of a SIDI fuel injector arrangement according to a first implementation of the present invention.

Referring now to FIG. 4, an isolated SIDI fuel injector system 100 according to the present invention is shown. A fuel injector 102 delivers fuel from an isolated fuel rail assembly 104 through a cylinder head 106 to a combustion chamber 108. Conventionally, SIDI fuel injectors (as well as SIDI fuel rail assemblies) are rigidly mounted and/or affixed to the cylinder head 106. In the present implementation, the fuel injector 102 is suspended from the fuel rail assembly 104 and is substantially mechanically isolated from the cylinder head 106, especially in the axial direction. The fuel injector 102 is directly coupled to the isolated fuel rail assembly 104 via an injector cup boss 110, an injector locating base 112, an injector seat 114, and a snap ring 116. The injector seat 114 supports a posterior spherical portion 118 of the injector locating base 112. The injector seat 114 (e.g. a split spherical seat or other suitable device) secures and maintains a desired position of the fuel injector 102 relative to the injector cup boss 110. An O-ring 120 provides a wet seal.

The snap ring 116 provides additional support to maintain the desired position of the fuel injector 102. The snap ring 116 may be removable to allow the fuel injector to be insertably coupled to and/or removed from the injector cup boss 110. The SIDI fuel injector system 100 may also include an anterior injector seat (not shown) that contacts an upper portion of the fuel injector 102 within the injector cup boss 110.

As described above, the fuel injector 102 is directly coupled to the fuel rail assembly 104 without rigid mechanical contact between the injector cup boss 110 and the cylinder head 106. The injector seat 114 limits the axial position of the fuel injector 102 with respect to the injector cup boss 110. In the present implementation, the injector seat 114 may be formed from an elastomeric material. Those skilled in the art can appreciate that the present invention is not limited to using elastomeric materials. Other materials, including, but not limited to, nylon, composites, and/or metals are anticipated. For example, thermal conductivity of an elastomeric material forming the injector seat 114 may be increased by the addition of aluminum particles.

Figure 1:
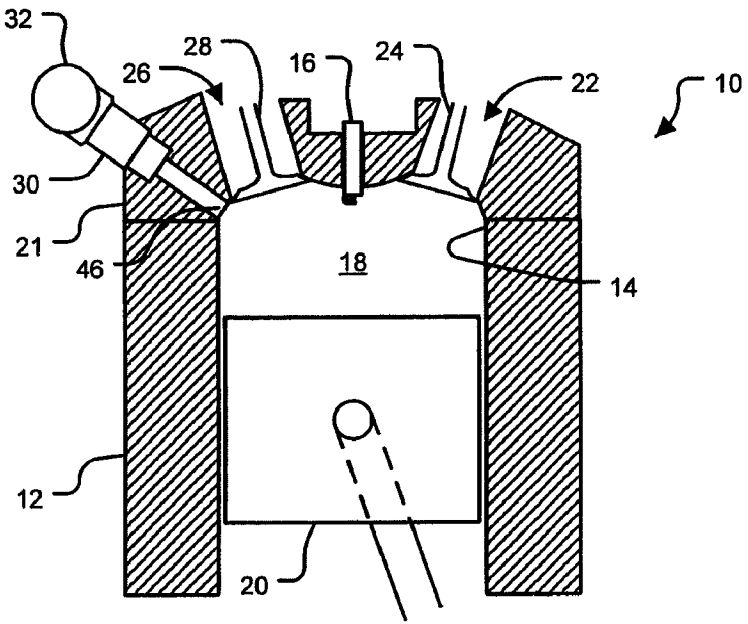
FIG. 1 Prior Art
FIG. 1 is a cross-sectional view of a spark ignition direct injection (SIDI) engine cylinder according to the prior art.
Figure 3A:
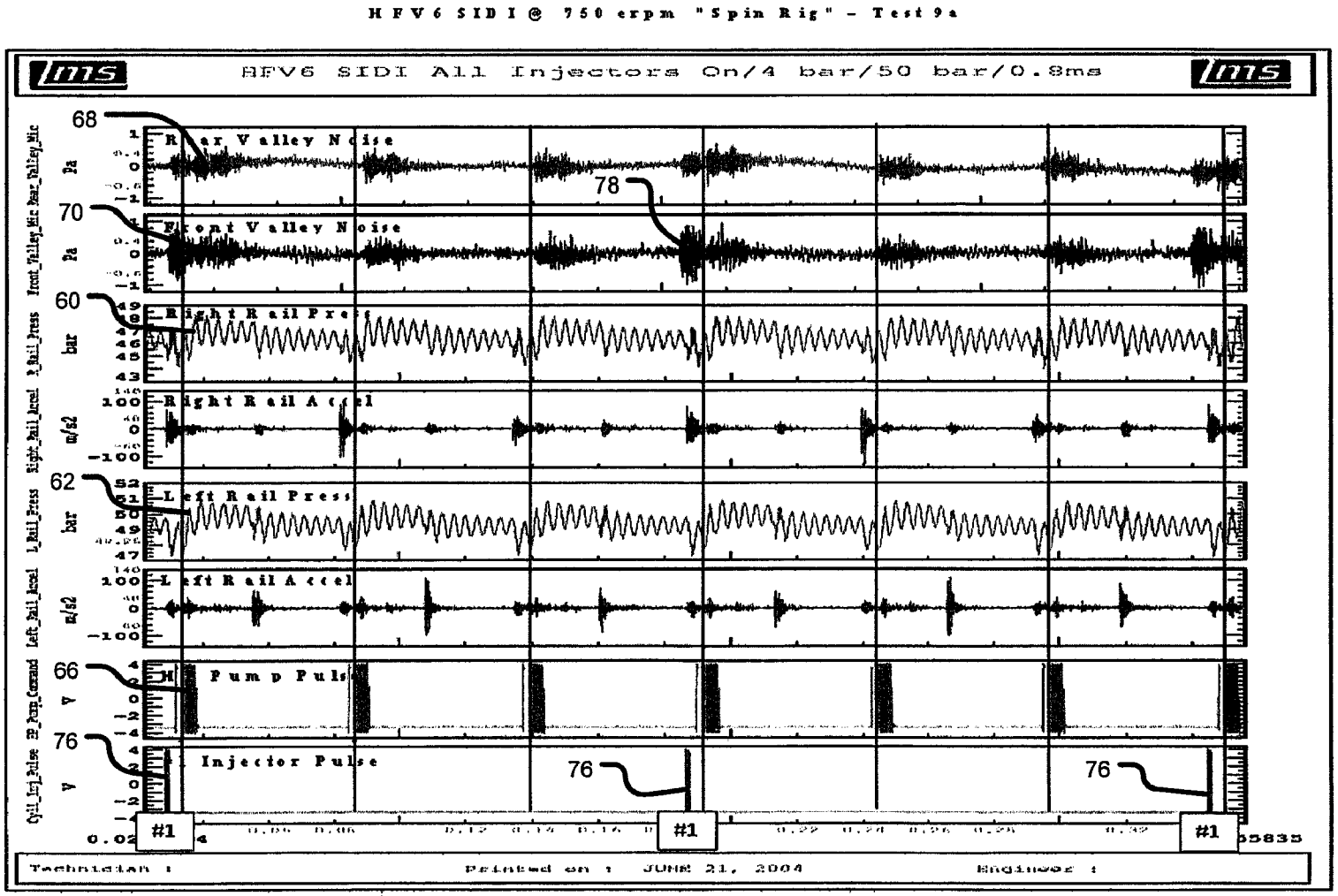
FIG. 3A Prior Art
FIG. 3A is a graphical representation of SIDI fuel system noise according to the prior art.
Figure 3B:
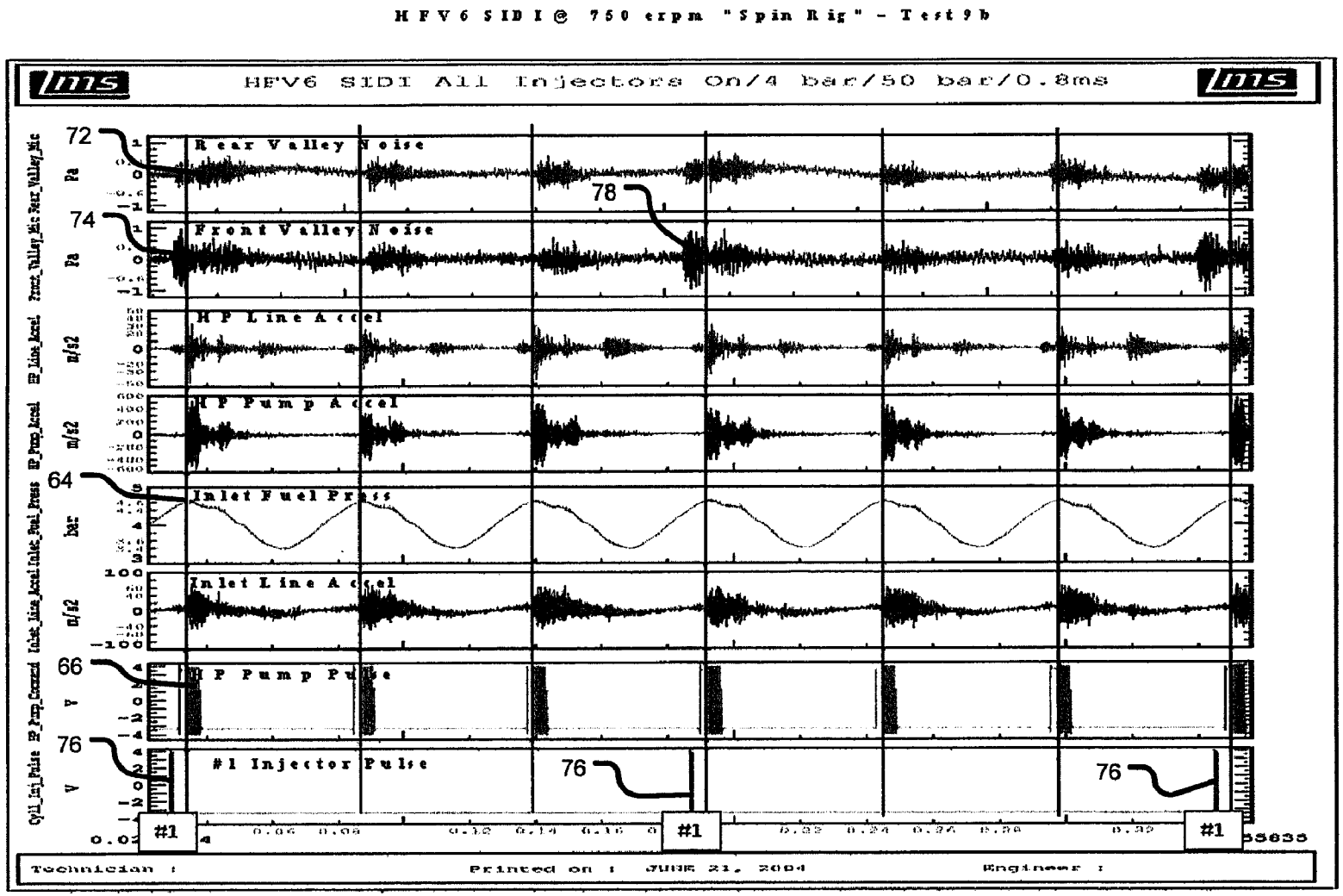
FIG. 3B Prior Art
FIG. 3B is a graphical representation of SIDI fuel system noise according to the prior art.

The cylinder head 106 includes an opening 122 that accommodates the fuel injector 102 and a fuel injector nozzle 124. In conventional SIDI systems (as described in FIG. 1), there is rigid mechanical contact between the cylinder head 106 and the fuel injector 102 to maintain a position of the fuel injector. As a result, noise is transferred between the fuel injector 102 and the cylinder head 106 via contiguous axial contact. In the present implementation, the fuel injector 102 floats in the opening 122, isolating the fuel injector 102 from the cylinder head 106. The fuel injector 102 includes a combustion seal (e.g. a nylon or Teflon combustion seal) 126 located near the fuel injector nozzle 124. The combustion seal 126 seals combustion gases from the combustion chamber 108 and is the only contact between the fuel injector 102 and the cylinder head. Thus, there is no metal-to-metal (i.e., rigid) contact of the injector with the cylinder head. In this manner, the isolated SIDI fuel injector system 100 eliminates substantial axial contact between the fuel injector 102 and the cylinder head 106.

Figure 5:
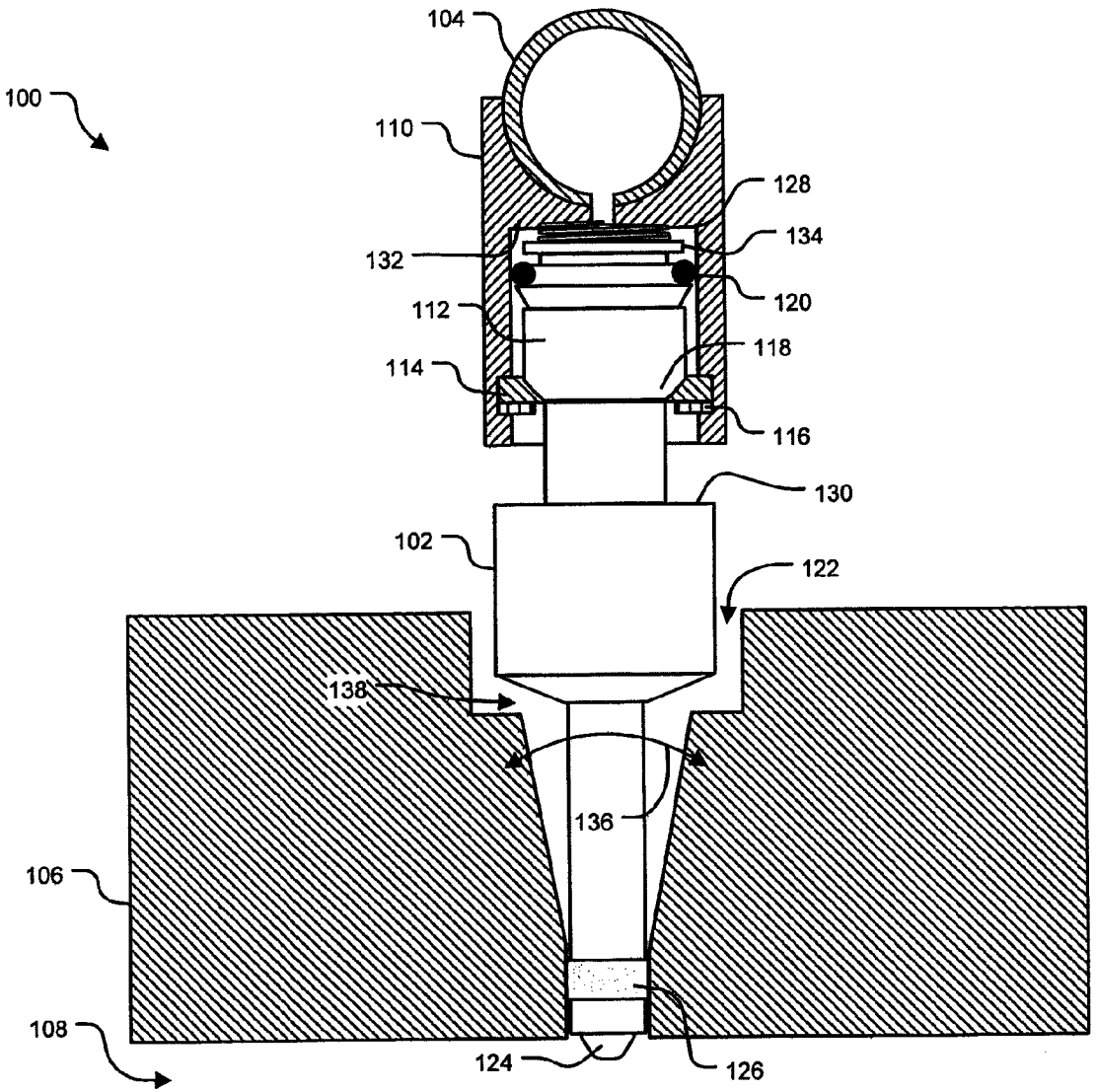
FIG. 5 is a cross-sectional view of a SIDI fuel injector arrangement according to a second implementation of the present invention.

A biasing element, such as a spring 128, may be included. The spring 128 provides a downward biasing force to position the fuel injector 102 within the cylinder head 106. However, it is to be understood that a biasing element is not required for proper positioning of the fuel injector 102. For example, an internal fuel rail pressure is typically sufficient to bias the fuel injector against the injector seat 114. Further, although the spring 128 is shown disposed between the injector cup boss 110 and an intermediate portion 130 of the fuel injector 102, those skilled in the art can appreciate that the spring 128 may be otherwise located. For example, the spring 128 may be located between an upper interior surface 132 of the injector cup boss 110 and an upper portion 134 of the fuel injector 102 as shown in FIG. 5.

As described above, a longitudinal position of the fuel injector 102 is maintained. In this manner, proper positioning of the fuel injector nozzle 124 for optimized combustion is maintained. Further and as indicated at 136, the configuration of the SIDI fuel injector system 100 allows angular rotation of the fuel injector 102 relative to the cylinder head 106. For example, the spherical portion 118 of the injector locating base 112 and the injector seat 114 allow a degree of angular latitude to compensate for misalignment and/or slight positional errors. The opening 122 is sufficiently large to accommodate angular rotation of the fuel injector 102 while maintaining isolation between the fuel injector 102 and the cylinder head 106. A gap between the fuel injector 102 and the cylinder head 106 as indicated at 138 allows for limited longitudinal movement of the fuel injector 102. For example, if the injector seat 114 compresses and/or the snap ring 116 is damaged, the fuel injector 102 will not necessarily contact the cylinder head 106. For example, a controlled clearance between the bottom of the injector base and the cylinder head port acts as a failsafe in the event of a improperly-positioned or snap ring 116. The injector is trapped between the rail and head thereby maintaining the integrity of the wet seal (i.e., the O-ring 120), with increased noise being the only degradation to the system.

Figure 6A:
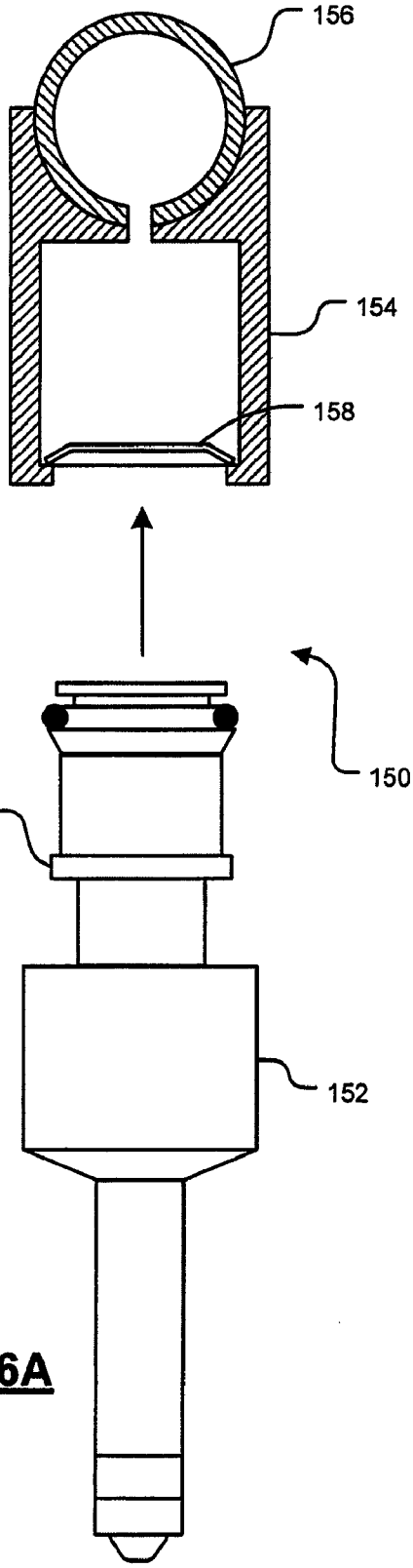
FIG. 6A is a cross-sectional view of a SIDI fuel injector mounting system according to a third implementation of the present invention.
Figure 6B:
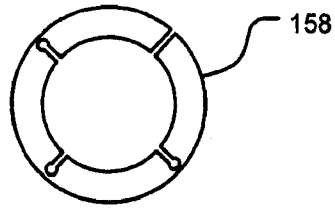
FIG. 6B illustrates a retainer clip used in a SIDI fuel injector mounting system according to the present invention.
Figure 6C:
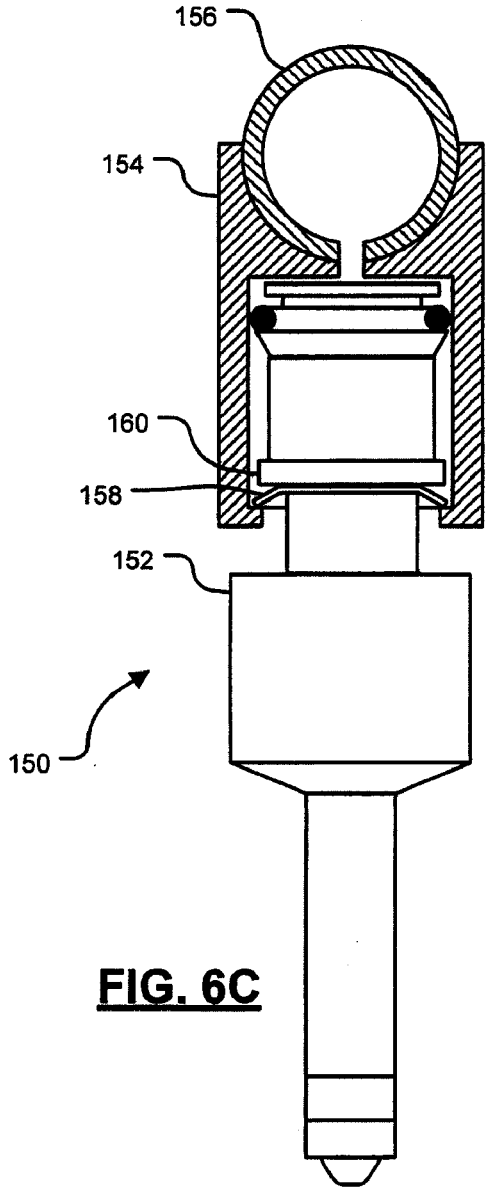
FIG. 6C is a cross-sectional view of an assembled SIDI fuel injector mounting system according to the present invention.

The isolated fuel injector arrangements of previous implementations may be combined and/or integrated with a fuel injector mounting system 150 as shown in FIGS. 6A, 6B, and 6C. A fuel injector 152 is inserted into an injector cup boss 154 of a fuel rail assembly 156. A retainer clip 158, shown in FIG. 6B and cross-sectionally in FIG. 6A, retains the fuel injector 152 within the injector cup boss 154. The retainer clip 158 engages a stepped collar 160 disposed on the fuel injector 152. As shown, the retainer clip 158 is a split-segmented snap retainer. However, those skilled in the art can appreciate that other types of retainer clips may be used. The fuel injector mounting system 150 allows for angular rotation and misalignment compensation as described in previous embodiments and facilitates attachment of the fuel injector 152 to the fuel rail assembly 156. Any suitable tool may be applied to release the retainer clip 158 and remove the fuel injector 152.

Figure 7:
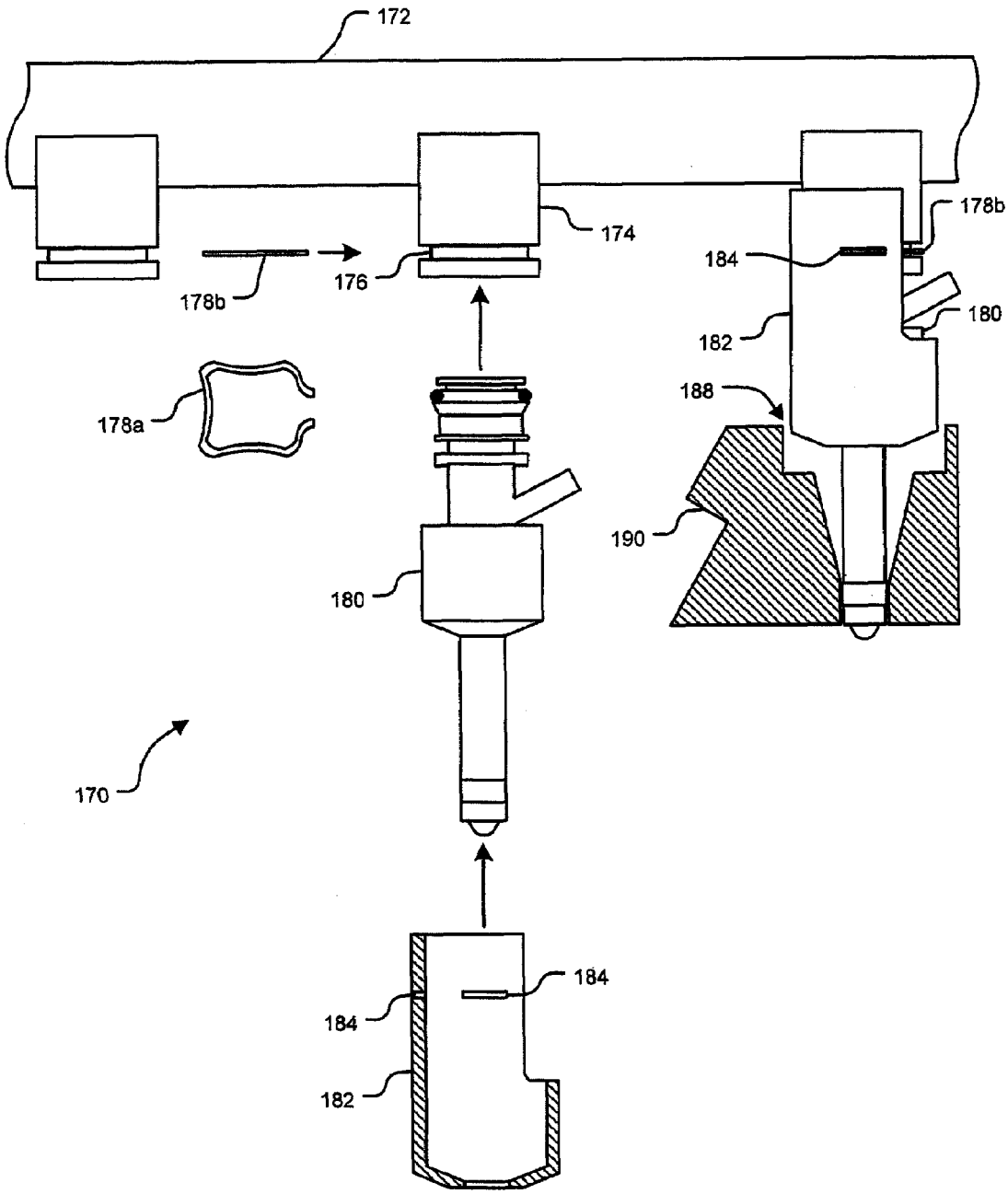
FIG. 7 is a cross-sectional view of a SIDI fuel injector mounting system according to a fourth implementation of the present invention.

An alternative implementation of a fuel injector mounting system 170 is shown in FIG. 7. A fuel rail assembly 172 includes one or more fuel injector retaining interfaces (e.g. injector cup bosses) 174. The interface 174 includes a retainer clip groove 176 that is configured to receive a retainer clip 178*a* (shown in profile at 178*b*). A fuel injector 180 is inserted within the interface 174. An injector sleeve 182 is inserted over the fuel injector 180 and the interface 174. The retainer clip 178*a* is inserted into one or more retainer clip slots 184 and through the retainer clip groove 176.

In this manner, the retainer clip 178*a*, in combination with the injector sleeve 182, maintains an axial/longitudinal position and a radial position of the fuel injector 180. A clearance gap 188 between the injector and cylinder head provides isolation as described in previous implementations. The features of the fuel injector mounting system 170 may be combined and/or integrated with previous implementations of the isolated fuel injectors as described in FIGS. 4-6.

Figure 8A:
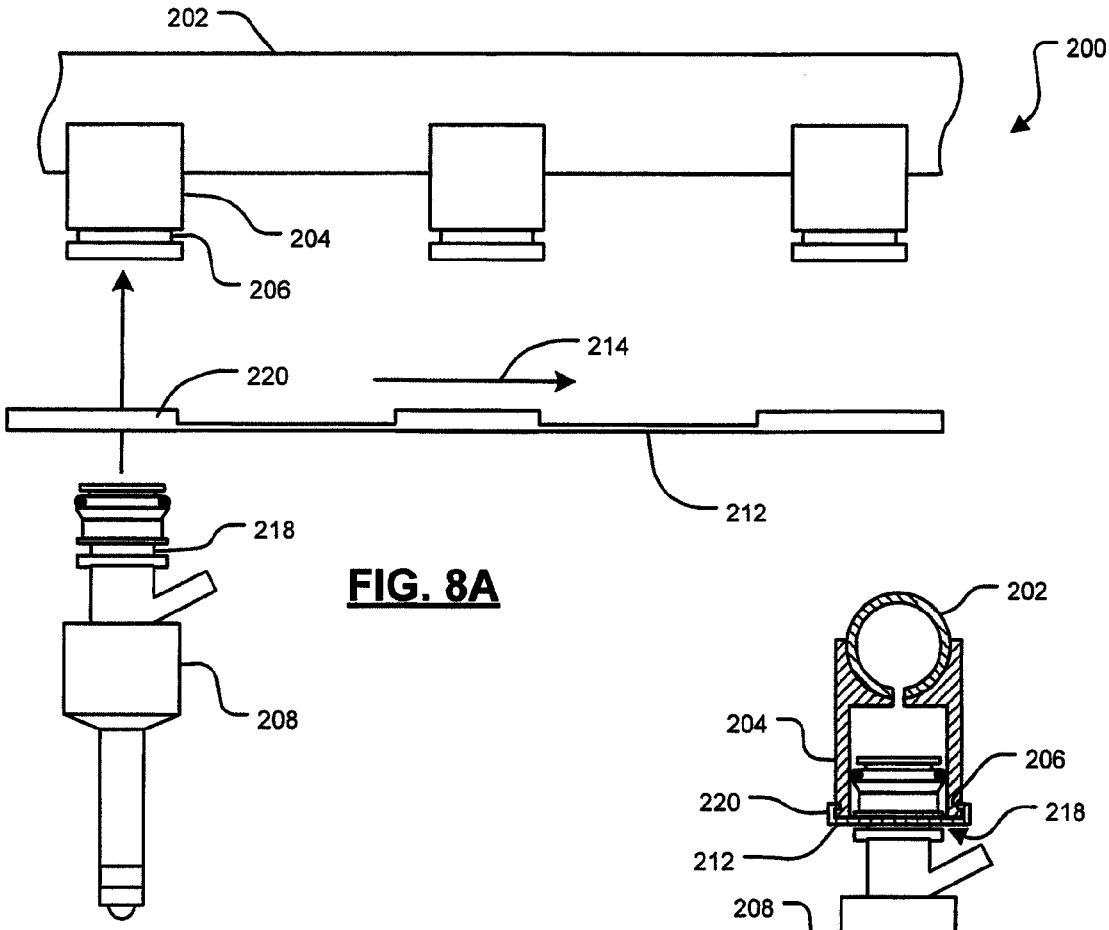
FIG. 8A is a cross-sectional view of a SIDI fuel injector mounting system according to a fifth implementation of the present invention.
Figure 8B:
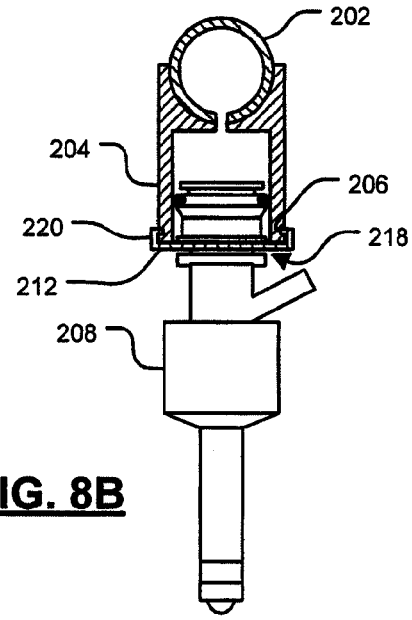
FIG. 8B is a cross-sectional view of an assembled SIDI fuel injector mounting system including a retainer plate according to the present invention.
Figure 8C:
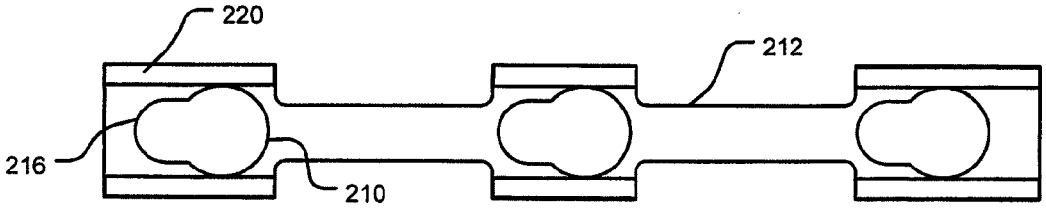
FIG. 8C is a fuel injector retainer plate according to the present invention.

Another implementation of a fuel injector mounting system 200 is shown in FIGS. 8A, 8B, and 8C. A fuel rail assembly 202 includes one or more injector retaining interfaces 204. The interface 204 includes a retainer plate groove 206. A fuel injector 208 is inserted into the interface 204 through an opening 210 in a retainer plate 212. When the fuel injector 208 is suitably positioned, the retainer plate 212 slides in a direction 214 parallel to the fuel rail assembly 202 to lock the fuel injector 208 in position within the interface 204. More specifically, a locking portion 216 of the opening 210 engages an injector retaining groove 218 of the fuel injector 208.

The retainer plate 212 includes retainer clips 220. When the retainer plate 212 is positioned to lock the fuel injector 208 in place, the retainer clips 220 engage the retainer plate grooves 206. In this manner, the retainer plate 212 maintains a position of the fuel injector 208 as described in previous implementations. In an alternative implementation, a plurality of individual retainer plates (not shown) that correspond to a plurality of retaining interfaces 204 may replace the continuous retainer plate 212.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel injector isolation system in a high pressure fuel injection system, comprising:

an isolated fuel rail assembly;

at least one cylinder having a cylinder head; and a fuel injector that is coupled to and in fluid communication with the fuel rail assembly, that extends along a first axis through an opening in the cylinder head, and that is moveable within the opening in an angular direction with respect to the first axis.

2. The fuel injector isolation system of claim 1 wherein the fuel injector is moveable in an axial direction in relation to the cylinder head.

3. The fuel injector isolation system of claim 1 wherein the fuel injector isolation system includes a clearance gap between the cylinder head and the fuel injector in at least one of a longitudinal direction and a lateral direction.

4. The fuel injector isolation system of claim 1 wherein an anterior portion of the opening is larger than a posterior portion of the opening to allow angular movement of the fuel injector in relation to the cylinder head.

5. The fuel injector isolation system of claim 4 further comprising a combustion seal located proximate a nozzle of the injector.

6. The fuel injector isolation system of claim 1 further comprising an injector cup boss that couples the fuel injector to the fuel rail assembly.

7. The fuel injector isolation system of claim 6 further comprising a biasing element located between the injector cup boss and the fuel injector that biases the fuel injector toward the cylinder head.

8. The fuel injector isolation system of claim 6 wherein the fuel injector is insertably coupled to an interior region of the injector cup boss.

9. A fuel injector isolation system in a high pressure fuel injection system, comprising:

an isolated fuel rail assembly;

at least one cylinder having a cylinder head;

a fuel injector coupled to and in fluid communication with the fuel rail assembly that extends axially through an opening in the cylinder head and is moveable within the opening in relation to the cylinder head;

an injector cup boss that couples the fuel injector to the fuel rail assembly; and an injector sleeve, wherein the injector sleeve couples the fuel injector to the injector cup boss and the fuel injector extends through an opening of the injector sleeve into the opening in the cylinder head.

10. A fuel injector isolation system in a high pressure fuel injection system, comprising:

an isolated fuel rail assembly;

at least one cylinder having a cylinder head;

a fuel injector coupled to and in fluid communication with the fuel rail assembly that extends axially through an opening in the cylinder head and is moveable within the opening in relation to the cylinder head;

an injector cup boss that couples the fuel injector to the fuel rail assembly;

at least one second injector cup boss;

at least one second fuel injector; and a retainer plate that couples the fuel injector to the injector cup boss and couples the at least one second fuel injector to the at least one second injector cup boss.

11. A vehicle comprising:

an engine block that includes at least one combustion cylinder having a cylinder head and a combustion chamber; and a high pressure fuel injection system that delivers fuel directly into the combustion chamber, the high pressure fuel injection system including:

an isolated fuel rail assembly; and a fuel injector that is coupled to and in fluid communication with the fuel rail assembly, that extends along a first axis through an opening in the cylinder head, and that is moveable within the opening in an angular direction with respect to the first axis.

12. The vehicle of claim 11 wherein the fuel injector is moveable in at least one of an angular direction and an axial direction in relation to the cylinder head.

13. The vehicle of claim 11 wherein the fuel injection system includes a clearance gap between the cylinder head and the fuel injector in at least one of a longitudinal direction and a lateral direction.

14. The vehicle of claim 11 wherein an anterior portion of the opening is larger than a posterior portion of the opening to allow angular movement of the fuel injector in relation to the cylinder head.

15. The vehicle of claim 14 further comprising a combustion seal located proximate a nozzle of the injector.

16. The vehicle of claim 12 further comprising an injector cup boss that couples the fuel injector to the fuel rail assembly.

17. The vehicle of claim 16 further comprising a biasing element located between the injector cup boss and the fuel injector that biases the fuel injector toward the cylinder head.

18. The vehicle of claim 17 wherein the fuel injector is insertably coupled to an interior region of the injector cup boss.

19. A vehicle comprising:

an engine block that includes at least one combustion cylinder having a cylinder head and a combustion chamber;

a high pressure fuel injection system that delivers fuel directly into the combustion chamber, the high pressure fuel injection system including:

an isolated fuel rail assembly; and a fuel injector coupled to and in fluid communication with the fuel rail assembly that extends axially through an opening in the cylinder head and is moveable in at least one of an angular direction and an axial direction within the opening in relation to the cylinder head;

an injector cup boss that couples the fuel injector to the fuel rail assembly; and an injector sleeve, wherein the injector sleeve couples the fuel injector to the injector cup boss and the fuel injector extends through an opening of the injector sleeve into the opening in the cylinder head.

20. A vehicle comprising:

an engine block that includes at least one combustion cylinder having a cylinder head and a combustion chamber;

a high pressure fuel injection system that delivers fuel directly into the combustion chamber, the high pressure fuel injection system including:

an isolated fuel rail assembly; and a fuel injector coupled to and in fluid communication with the fuel rail assembly that extends axially through an opening in the cylinder head and is moveable in at least one of an angular direction and an axial direction within the opening in relation to the cylinder head;

an injector cup boss that couples the fuel injector to the fuel rail assembly;

at least one second injector cup boss;

at least one second fuel injector; and a retainer plate that couples the fuel injector to the injector cup boss and couples the at least one second injector cup boss to the at least one second fuel injector.

* * * * *